US009116501B2

(12) United States Patent
Hamaya et al.

(10) Patent No.: US 9,116,501 B2
(45) Date of Patent: Aug. 25, 2015

(54) CONNECTION ELECTRODE, ATTACHMENT UNIT, AND IMAGE FORMING APPARATUS COMPRISING THE SAME

(71) Applicant: Brother Kogyo Kabushiki Kaisha, Nagoya (JP)

(72) Inventors: Masahito Hamaya, Nagoya (JP); Shiro Ueno, Ichinomiya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/445,741

(22) Filed: Jul. 29, 2014

(65) Prior Publication Data

US 2015/0037060 A1 Feb. 5, 2015

(30) Foreign Application Priority Data

Jul. 31, 2013 (JP) ..... 2013-159369

(51) Int. Cl.
*G03G 21/16* (2006.01)
*G03G 15/00* (2006.01)
*G03G 21/18* (2006.01)

(52) U.S. Cl.
CPC ..... *G03G 21/1652* (2013.01); *G03G 15/80* (2013.01); *G03G 21/1867* (2013.01)

(58) Field of Classification Search
CPC ..... G03G 21/1652; G03G 15/80; G03G 21/1867; G03G 2221/166
See application file for complete search history.

(56) References Cited

U.S. PATENT DOCUMENTS

2011/0065336 A1* 3/2011 Souda ..... 439/824
2014/0153952 A1* 6/2014 Okamoto ..... 399/90

FOREIGN PATENT DOCUMENTS

JP 2005-041186 A 2/2005

* cited by examiner

*Primary Examiner* — Walter L Lindsay, Jr.
*Assistant Examiner* — Rodney Bonnette
(74) *Attorney, Agent, or Firm* — Burr & Brown, PLLC

(57) ABSTRACT

An image forming apparatus, comprising: a frame body to which an attachment unit is detachably attachable, the attachment unit being configured to have an input electrode and to be used for image formation on a recording medium; a power source substrate configured to have an output electrode for outputting a voltage and to be attached to the frame body from an opposite side with respect to a side on which the attachment unit is attached; and a connection electrode configured to electrically connect the output electrode to the input electrode of the attachment unit, wherein the frame body comprises an insertion part into which the connection electrode is inserted from an opposite side with respect to a side on which the power source substrate is attached.

11 Claims, 8 Drawing Sheets

CONNECTION ELECTRODE, ATTACHMENT UNIT, AND IMAGE FORMING APPARATUS COMPRISING THE SAME

CROSS-REFERENCE TO RELATED APPLICATION

This application claims priority under 35 U.S.C. §119 from Japanese Patent Application No. 2013-159369, filed on Jul. 31, 2013. The entire subject matter of the application is incorporated herein by reference.

BACKGROUND

1. Technical Field

Aspects of the present invention relate to an image forming apparatus and a manufacturing method for the image forming apparatus, and particularly to a technology for attaching a power source substrate to the image forming apparatus.

2. Related Art

In general, in an image forming apparatus, a power source substrate is provided. For example, a power source substrate is attached to a frame body of an image forming apparatus such that a coil spring attached to the frame body is covered by the power source substrate.

SUMMARY

However, when a worker moves the power source substrate to approach the coil spring, the work will become unable to visually observe the coil spring. In this case, there is a possibility that the power source substrate is attached to the frame body in a state where a connection electrode contacting the power source substrate is buckled, and thereby electric connection failure occurs between an electrode of the coil spring and the power source substrate.

Aspects of the present invention are advantageous in that they provide an image forming apparatus and a manufacturing method thereof capable of preventing occurrence of electric connection failure between a connection electrode and a power source substrate.

According to an aspect of the invention, there is provided an image forming apparatus, comprising: a frame body to which an attachment unit is detachably attachable, the attachment unit being configured to have an input electrode and to be used for image formation on a recording medium; a power source substrate configured to have an output electrode for outputting a voltage and to be attached to the frame body from an opposite side with respect to a side on which the attachment unit is attached; and a connection electrode configured to electrically connect the output electrode to the input electrode of the attachment unit. The frame body comprises an insertion part into which the connection electrode is inserted from an opposite side with respect to a side on which the power source substrate is attached.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereafter, embodiments according to the invention will be described with reference to the accompanying drawings.

First Embodiment

Hereafter, a first embodiment is explained with reference to FIGS. 1 to 10.

1. Overall Configuration of Printer

Figure 1:
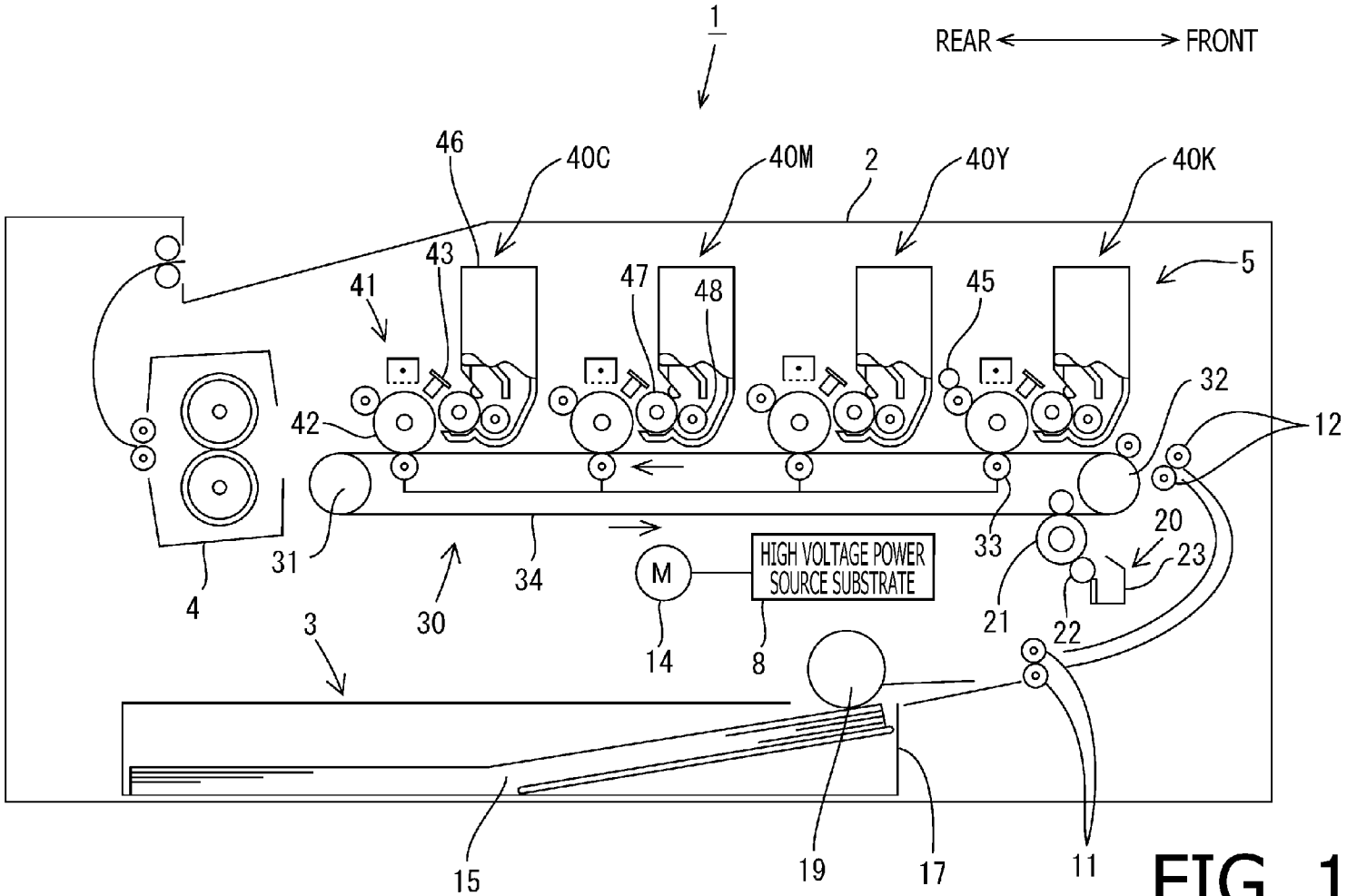
FIG. 1 is a cross section generally illustrating an internal configuration of a color printer according to a first embodiment.

A color printer 1 shown in FIG. 1 is an example of an image forming apparatus. In the following explanation, when components are explained separately in regard to colors, suffixes of Y (yellow), M (magenta), C (cyan) and K (black) are added to such components, respectively. On the other hand, when such components are explained without differentiating in regard to colors, such suffixes are omitted. It is understood that the image forming apparatus is not limited to a color printer, but may be a multifunction peripheral having the facsimile function and the copying function, or a monochrome printer.

The color printer (hereafter, simply referred to as a "printer") 1 includes, in a body casing, a paper supply unit 3, a fixing unit 4, an image formation unit 5, a belt cleaning head 20, a belt unit 30, a high voltage power unit 50 and a frame (6A and 6B). The printer 1 forms, on a sheet (e.g., a sheet of paper, an OHP sheet and etc.), toner images of a plurality of colors (four colors of yellow, magenta, cyan and black in this embodiment) based on image data inputted thereto externally. The upper portion of the body casing is formed as an upper surface cover 2 which is openable and closable. Further, the body casing includes a side cover 9 (see FIG. 2).

The paper supply unit 3 is provided in a lowermost portion of the printer 1, and includes a tray 17 which accommodates the sheet 15 (an example of a recording medium) and a pickup roller 19. The sheet 15 accommodated in the tray 17 is picked up one by one by the pickup roller 19, and is sent to the belt unit 30 via a conveying roller 11 and a registration roller 12.

The belt unit 30 serves to principally convey the sheet 15, and is detachably attachable to a mounting portion (not shown) formed in the printer 1. The belt unit 30 includes a drive roller 31, a driven roller 32 and a belt 34. The belt 34 is provided to extend between the drive roller 31 and the driven roller 32. When the drive roller 31 is rotated, a surface of the belt 34 facing photosensitive drums 42 moves from the right side to the left side in FIG. 1. As a result, the sheet 15 sent from the registration roller 12 is conveyed to a portion under the image formation unit 5. The belt unit 30 further includes four transfer rollers 33.

The image formation unit 5 includes four process units 40Y, 40M, 40C and 40K and four exposure devices 43. Each process unit 40 includes a charger 41, the photosensitive drum 42, a drum cleaner roller 44, a paper dust removing roller 45, a unit case 46, a development roller 47 and a supply roller 48. Each of the process units 40Y, 40M, 40C and 40K is detachably attachable to the frame (6A and 6B) formed in the printer 1 via the upper cover 2 (see FIG. 2).

Figure 3:
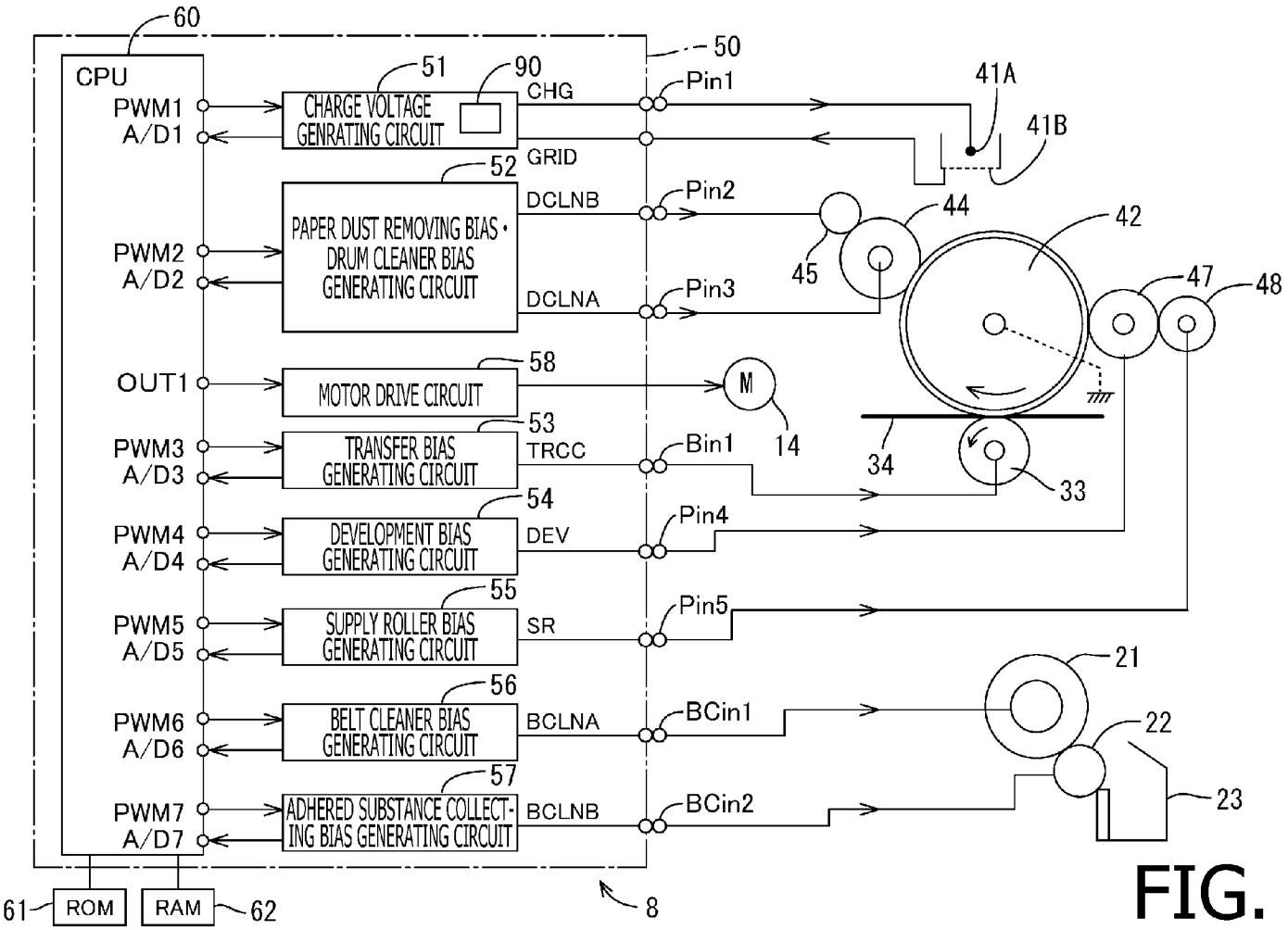
FIG. 3 illustrates a block diagram of a high voltage power unit mounted on a high voltage power source substrate and a related connection configuration.

The photosensitive drum 42 is formed, for example, by forming a positive charge type photosensitive layer on a base made of aluminum, and the base made of aluminum is connected to a ground line (see FIG. 3). The charger 41 is, for example, a scorotron charger, and includes a discharge wire 41A and a grid 41B (see FIG. 3). A charge voltage CHG is applied to the discharge wire 41A, and a grid voltage GRID of the grid 41B is controlled such that the entire surface of the photosensitive drum 42 has substantially the same potential (e.g., +700V).

The exposure device 43 includes, for example, a plurality of light emitting devices (e.g., LEDs) arranged in a row along a rotation axis direction of the photosensitive drum 42. By controlling light emission of the plurality of light emitting devices in accordance with image data inputted externally, an electrostatic latent image is formed on the surface of the photosensitive drum 42. The exposure device 43 is fixed in the printer 1. The exposure device 43 may be configured by using a laser source.

Each unit case 46 accommodates toner of corresponding one of the colors, and includes the development roller 47 and the supply roller 48. Through rotations of the supply roller 48, the toner is supplied to the development roller 47, and is frictionally charged positively between the supply roller 48 and the development roller 47. Further, by supplying the toner to the photosensitive drum 42 as a uniform thin layer, the electrostatic latent image is developed, and a toner image is formed on the photosensitive drum 42.

Each transfer roller 33 is disposed at a position where the belt 34 is pinched between the transfer roller 33 and the photosensitive drum 42. With respect to the photosensitive drum 42, each transfer roller 33 is applied a transfer bias TRCC having an opposite polarity to the charge polarity of the toner, by which the toner image formed on the photosensitive drum 42 is transferred to the sheet 15. Thereafter, the sheet 15 is conveyed to the fixing unit 4 by the belt unit 30, and the toner image thermally fixed by the fixing unit 4. Then, the sheet 15 is discharged to the upper surface of the printer 1.

A drum cleaning mechanism including the drum cleaner roller 44 and the paper dust removing roller 45 removes adhered substances (toner or paper dust) on the photosensitive drum 42 by sucking them with an electrostatic force. For example, the paper dust removing roller 45 is provided only in the process unit 40K.

Further, the belt cleaning unit 20 is disposed under the belt unit 30, and is detachably attachable to a mounting portion (not shown). The belt cleaning unit 20 includes a belt cleaning roller 21, an adhered substance collecting roller 22 and a collecting box 23. The belt cleaning unit 20 is configured to collect adhered substances on the belt 34 (principally, toner and etc. remaining on the belt 34).

2. High Voltage Power Unit

Next, an electric configuration of the printer 1 is explained with reference to FIG. 3. The high voltage power unit 50 includes voltage generating circuits respectively corresponding to the process units 40Y, 40M, 40C and 40*k;* however, in FIG. 3 only a voltage generating circuit relating to the process unit 40K is illustrated because the configurations of voltage generating circuits corresponding to the process units 40Y, 40M, 40C and 40*k* are the same.

The high voltage power unit 50 includes a CPU 60, a plurality of voltage generating circuits connected to the CPU 60, a motor drive circuit 58, a ROM 61 and a RAM 62. The CPU 60 totally controls the entire printer in addition to controlling the voltage generating circuits. The ROM 61 stores, for example, operation programs for control of the whole printer, and the RAM 62 stores, for example, image data used for a print process.

As shown in FIG. 3 by way of example, the plurality of voltage generating circuits include a charge voltage generating circuit 51, a paper dust removing bias•drum cleaner bias generating circuit 52, a transfer bias generating circuit 53, a development bias generating circuit 54, a supply roller bias generating circuit 55, a belt cleaner bias generating circuit 56 and an adhered substance collecting bias generating circuit 57.

The charge voltage generating circuit 51 includes a mold type transformer 90, and generates a charge voltage CHG to be applied to the discharge wire 41*a* of the charger 41 and a grid voltage GRID to be applied to the grid 41B of the charger 41. The charge voltage CHG is, for example, 5.5 kV to 8 kV (positive), and the grid voltage GRID is, for example, approximately 700V (positive). For example, the grid voltage GRID is generated by voltage division of the charge voltage caused by a discharge resistance produced during the discharging between the discharge wire 41A and the grid 41B and a voltage divider resistance provided in the charge voltage generating circuit 51. The mold type transformer 90 is molded with insulating resin except electrode parts thereof, such as an output electrode 91 (see FIG. 4).

For example, the charge voltage generating circuit 51 generates the charge voltage CHG in accordance with a PWM signal from a PWM1 port of the CPU 60, and is subjected to feedback control through an A/D 1 port.

The paper dust removing bias•drum cleaner bias generating circuit 52 generates a paper dust removing bias DCLNB to be applied to the paper dust removing roller 45 and a drum cleaner bias DCLNA to be applied to the drum cleaner roller 44. The paper dust removing bias DCLNB is, for example, approximately 100V (positive) during toner sucking, and is, for example, approximately 800V (positive) during toner ejection and paper dust sucking The drum cleaner bias DCLNA is, for example, approximately −100V (negative) during toner sucking, and is, for example, approximately 600V (positive) during the toner ejection and paper dust sucking In this embodiment, the paper dust removing bias•drum cleaner bias generating circuit 52 generates the paper dust removing bias DCLNB in accordance with the PWM signal from the PWM port 2 of the CPU 60, and generates the drum cleaner bias DCLNA based on the paper dust removing bias DCLNB. The paper dust removing bias DCLNB is subjected to feedback control through an A/D 2 port. The drum cleaner bias DCLNA and the paper dust removing bias DCLNB may be separately generated by separate voltage generating circuits.

The transfer bias generating circuit 53 generates a transfer bias TRCC to be applied to the transfer roller 33. The transfer bias TRCC is, for example, approximately −7 kV (negative). For example, the transfer bias generating circuit 53 generates the transfer bias TRCC in accordance with the PWM signal from a PWM port 3, and the transfer bias TRCC is subjected to feedback control through an A/D 3 port.

The development bias generating circuit 54 generates a development bias DEV to be applied to the development roller 47. The development bias DEV is, for example, approximately 400V to 550V (positive). The development bias generating circuit 54 generates the development bias DEV in accordance with the PWM signal from a PWM 4 port of the CPU 60, and is subjected to feedback control via an A/D 4 port.

The supply roller bias generating circuit 55 generates a supply roller bias SR to be applied to the supply roller 48. The supply roller bias SR is, for example, approximately 500 to 650V (positive). For example, the supply roller bias generating circuit 55 generates the supply roller bias SR in accordance with the PWM signal from a PWM 5 port, and the supply roller bias SR is subjected feedback control via an A/D 5 port.

The belt cleaner bias generating circuit 56 generates a belt cleaner bias BCLNA to be applied to the belt cleaner roller 21. The belt cleaner bias BCLNA is, for example, approximately −1200V (negative). For example, the belt cleaner bias generating circuit 56 generates the belt cleaner bias BCLNA in accordance with the PWM signal from a PWM 5 port of the CPU 60, and the belt cleaner bias BCLNA is subjected to feedback control via an A/D 6 port.

The adhered substance collecting bias generating circuit 57 generates an adhered substance collecting bias BCLNB to be applied to the adhered substance collecting roller 22. The adhered substance collecting bias BCLNB is, for example, approximately −1600V (negative). For example, the adhered substance collecting bias generating circuit 57 generates the adhered substance collecting bias BCLNB in accordance with the PWM signal from a PWM 7 port, and the adhered substance collecting bias BCLNB is subjected to feedback control via an A/D 7 port.

The motor drive circuit 58 droves a main motor 14 under control of the CPU 60. In accordance with rotation control for the main motor 14, rotations of the various motors are controlled.

Figure 2:
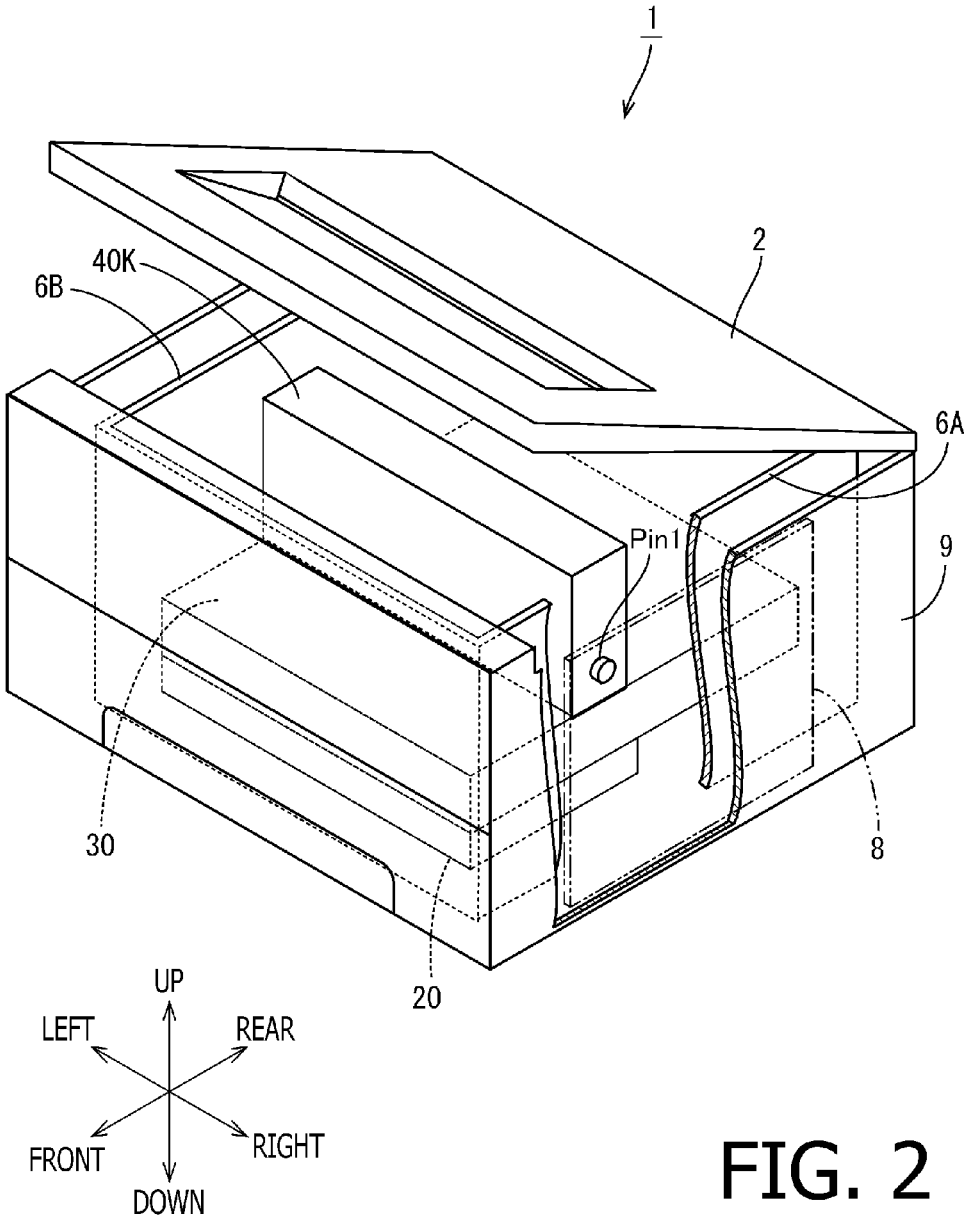
FIG. 2 is an explanatory illustration for explaining a positional relationship between an attachment unit and a high voltage power source substrate in the printer.

3. Connection Configuration of Attachment Unit and High Voltage Power Source Substrate Hereafter, the connection configuration of the attachment unit and a high voltage power source substrate 8 are explained with reference to FIGS. 4 to 6. Specifically, a connecting configuration between the input electrode Pin1 of the charger 41 of the process unit 40K and the mold type transformer 90 of the charge voltage generating circuit 51 mounted on the high voltage power source substrate 8 is explained. Since the connecting connections regarding the other process units 40Y, 40M and 40C are the same as that of the process unit 40K, explanations thereof are omitted. A general positional relationship between the process unit 40K and the high voltage power source substrate 8 is shown in FIG. 2.

Figure 4:
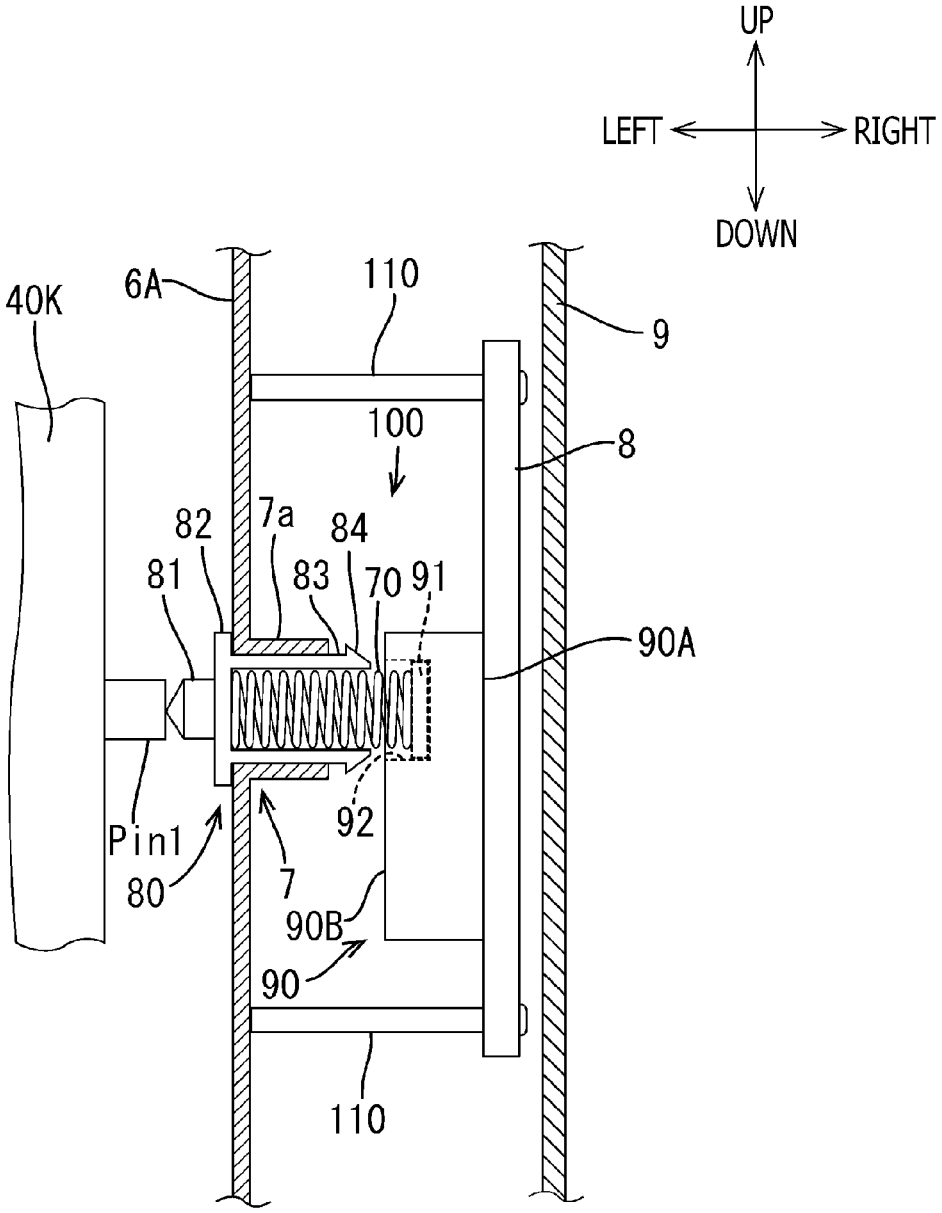
FIG. 4 is a cross sectional view illustrating a connecting manner by a connection electrode.

As shown in FIG. 4, the mold type transformer 90 has the output electrode 91 for outputting the charge voltage CHG to the charger 41. The output electrode 91 is provided on a surface 90B of the mold type transformer 90 which is opposite to a contacting surface 90A of the mold type transformer 90 contacting the high voltage power source substrate 8. More specifically, as shown in FIG. 4, the mold type transformer 90 has a recessed part 92 which is provided on the surface 90B opposite to the contacting surface 90A and at a position facing the input electrode Pin 1 of the process unit 40K. The output electrode 91 is provided in the recessed part 92. By thus providing the output electrode 91 in the recessed part 92 of the mold type transformer 90, it is possible to cause a connection electrode 100 to securely contact the output electrode 91 even when a connection electrode formed in a shape which is easily buckled is used as the connection electrode 100. As a result, reliability of electric connection can be enhanced.

Figure 5:
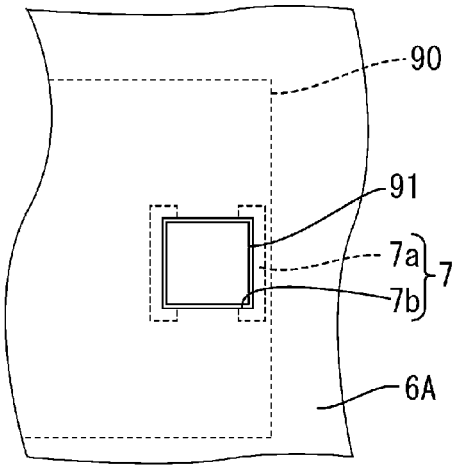
FIG. 5 is a partial plan view illustrating a positional relationship between an insertion part and an output electrode according to the first embodiment.

The printer 1 includes the output electrode 91 of the mold type transformer 90 and the connection electrode 100 to be electrically connected to the input electrode Pin1 of the process unit 40K. Further, as shown in FIGS. 4 and 5, the frame 6A has an insertion part 7 into which the connection electrode 100 is inserted from an opposite side of the side on which the high voltage power source substrate 8 is attached.

The insertion part 7 is formed as a part of the frame 6A, and is made of resin. As shown in FIG. 4, the insertion part 7 includes a bending part 7*a* which forms an insertion path into which the connection electrode 100 is inserted as shown in FIG. 4, and an opening part 7*b* having a square shape when viewed as a plan view as shown in FIG. 5. In this embodiment, the frame 6A is made of resin, and therefore the bending part 7*a* is also made of resin. However, in another embodiment, the frame 6A may be made of metal. In this case, at least the bending part 7*a* is made of resin.

Figure 6:
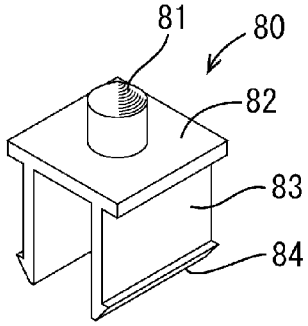
FIG. 6 is a perspective view of a second conductive member according to the first embodiment.

As shown in FIGS. 4 and 6, the connection electrode 100 includes a first conductive member 70 which contacts the output electrode 91 of the mold type transformer 90, and a second conductive member 80 which contacts the input electrode Pin1 of the process unit 40K. By thus configuring the connection electrode 100 with separate members, i.e., the first conductive member 70 and the second conductive member 80, it becomes possible to achieve connection configurations respectively suitable for the output electrode 91 of the mold type transformer 90 and the input electrode Pin1 of the process unit 40K.

The first conductive member 70 is a pressing member which is extensible in the direction in which the connection electrode 100 is inserted into the insertion part 7 (in the left and right direction in FIG. 4). In this embodiment, as shown in FIG. 4, the first conductive member 70 is formed of a coil spring. As described above, by using the coil spring 70 being a pressing member as the first conductive member 70, it becomes possible to prevent the output electrode 91 from being damaged when the coil spring 70 contacts the output electrode 91.

The second conductive member 80 has a fixing part (83 and 84) which is fixed to the frame 6A in a state where the insertion part 7 is inserted into the second conductive member 80. As shown in FIG. 6, the fixing part includes a spring part 83 and a stopper part 84 formed at a tip of the spring part 83. The stopper part 84 expands the insertion part 7 when the stopper part 83 is inserted the second conductive member 80 (specifically, the stopper part 84 expands the bending part 7*a* of the insertion part 7), and is hooked to the bending part 7*a* after the insertion. By thus providing the fixing part (83 and 84) for the second conductive member 80, it becomes possible to prevent occurrence of a state where the second conductive member 80 comes off the insertion part 7 after insertion to the insertion part 7 and thereby electric connection failure occurs between the process unit 40K and the high voltage power source substrate 8. By configuring the fixing part with the spring part 83 and the stopper part 84, the fixing part is realized as a simple configuration.

The second conductive member 80 includes a contacting part 81 which contacts the input electrode Pin1 of the process unit 40K, and a flange part 82 which contacts the surface of the frame 6A in the state where the second conductive member 81 is inserted into the insertion part 7.

4. Attaching Method of Connection Electrode

Hereafter, an attaching method for attaching the connection electrode 100 to the insertion part 7 of the frame 6A, i.e., a manufacturing method of the printer 1, is explained with reference to FIGS. 7 to 10. In each of FIGS. 7 to 10, a partial cross section which is obtained by cutting a central portion of the insertion part 7 shown in FIG. 5 in the left and right direction is illustrated.

Figure 7:
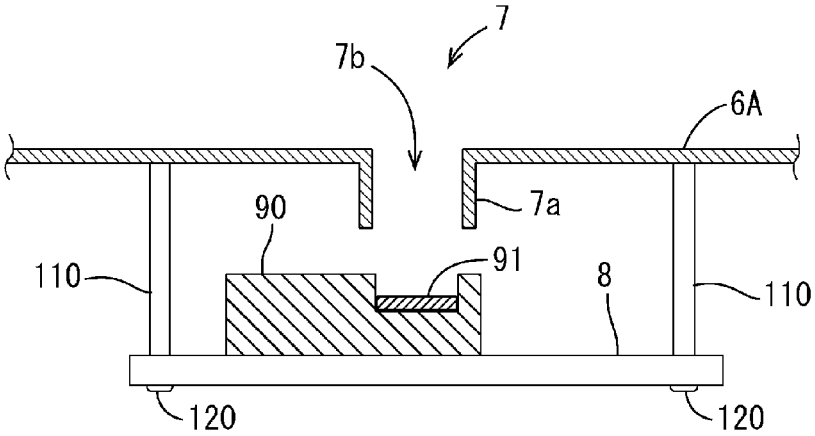
FIG. 7 is a cross sectional view illustrating an attaching manner of the connection electrode to the insertion part.

As shown in FIG. 7, first the high voltage power source substrate 8 on which the high voltage power unit 50 is mounted is attached to the frame 6A. As an example of an attaching method for the high voltage power source substrate 8, the high voltage power source substrate 8 is fastened to a plurality of substrate attaching poles provided on the frame 6A with screws 120. In this case, the positional relationship between the insertion part 7 of the frame 6A and the output electrode 91 of the mold type transformer 90 is illustrated in FIG. 5 as a plan view.

Next, the connection electrode 100 is inserted into the insertion part 7 from an opposite side of the side on which the high voltage power source substrate 8 is attached to the frame 6A so that the connection electrode 100 contacts the output electrode 91 of the high voltage power source substrate 8.

Figure 8:
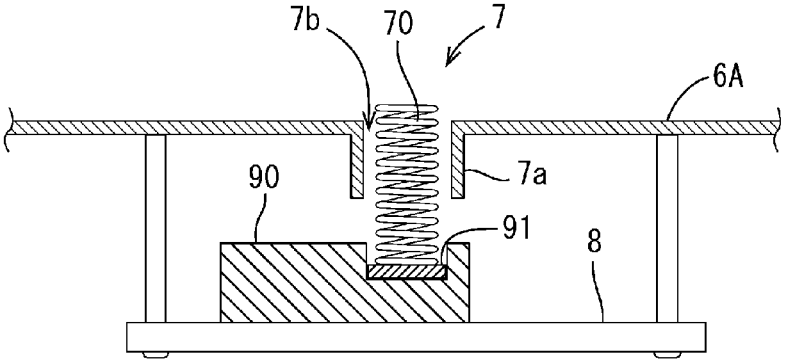
FIG. 8 is a cross sectional view illustrating the attaching manner of the connection electrode to the insertion part.
Figure 10:
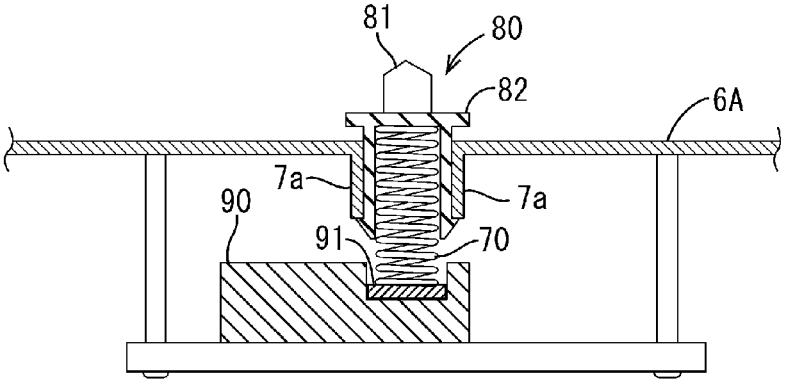
FIG. 10 is a cross sectional view illustrating the attaching manner of the connection electrode to the insertion part.

In this case, as shown in FIG. 8, first the coil spring 70 is inserted into the insertion part 7 so that the coil spring 70 contacts the output electrode 91 of the mold type transformer 90. Next, as shown in FIG. 10, by inserting the second conductive member 80 into the insertion part 7, the coil spring 70 is shrunk and fixed by the second conductive member 80, and the second conductive member 80 is fixed to the frame 6A. That is, the second conductive member 80 is inserted into the insertion part 7, the stopper part 84 of the second conductive member 80 is hooked to the bending part 7*a* of the insertion part 7 and thereby the second conductive member 80 is fixed to the frame 6A.

Figure 9:
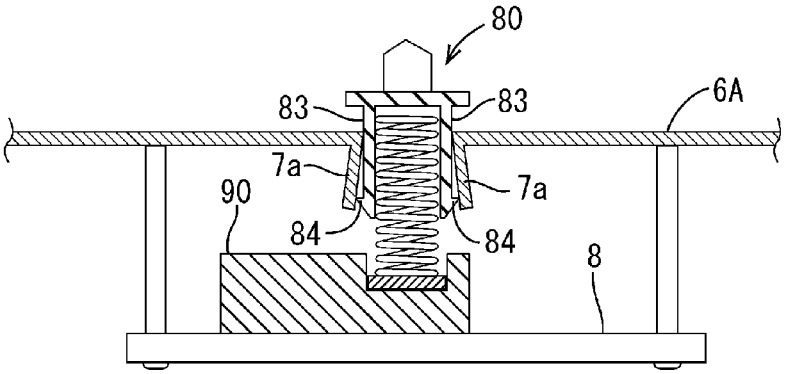
FIG. 9 is a cross sectional view illustrating the attaching manner of the connection electrode to the insertion part.

As shown in FIG. 9, when the second conductive member 80 is inserted into the insertion part 7, the stopper part 84 of the second conductive member 80 presses outward the bending part 7*a* of the insertion part 7, and thereby the bending part 7*a* of the insertion part 7 is broadened and the spring part 83 of the second conductive member 80 deforms inward by a repellent force of the bending part 7*a*. Then, when the second conductive member 80 is further inserted into the insertion part 7 and the stopper part 84 of the second conductive member 80 reaches the tip of the bending part 7*a* of the insertion part 7, the second conductive member 80 is fixed to the frame 6A by a restoration force of the bending part 7*a* of the insertion part 7 and the spring part 83 of the second conductive member 80.

When the process unit 40K is attached to the frame 6A and 6B, the input electrode Pin1 of the process unit 40K presses the contacting part 81 of the second conductive member 80 toward the output electrode 91 of the mold type transformer 90, and thereby the second conductive member 80 is moved in the inserting direction. Accordingly, the coil spring 70 shrinks until the flange part 82 of the second conductive member 80 contacts the frame 6A (see FIG. 4). As a result, the connection between the input electrode Pin1 of the process unit 40K and the output electrode 91 of the mold type transformer 90 is securely achieved.

In this embodiment, only the connection between the output electrode 91 of the mold type transformer 90 of the charge voltage generating circuit 51 mounted on the high voltage power source substrate 8 and the input electrode Pin1 of the charger 41 of the process unit 40K is explained by way of example. However, connection between an output electrode of another mold type transformer on the high voltage power source substrate and an input electrode Pin of the charger of another process unit is also be achieved in the same way. That is, as in the case of the connection between the output electrode 91 of the mold type transformer 90 of the charge voltage generation circuit 51 and the charger 41 of the process unit 40, connection between an output electrode of a mold type transformer in another high voltage generating circuit of the high voltage power unit 50 mounted on the high voltage power source substrate 8 shown in FIG. 3 and an input electrode of a corresponding attachment unit is also be achieved in the same way.

For example, when the process unit 40 is defined as an attachment unit, connection between an output electrode of a mold type transformer included in the development bias generating circuit 54 and the input electrode Pin4 of the development roller 47 provided in the process unit 40 is also achieved in the same way.

When the belt cleaning unit 20 is defined as an attachment unit is, connection between an output electrode of a mold type transformer included in the belt cleaner bias circuit 56 and the input electrode BCin1 of the belt cleaning roller 21 is also achieved in the same way.

When the belt unit 30 is defined as an attachment unit, connection between an output electrode of a mold type transformer included in the transfer bias generating circuit 53 and the input electrode Bin1 of the transfer roller 33 provided in the belt unit 30 is also achieved in the same way.

5. Advantageous effect of First Embodiment

The connection electrode 100 can be inserted into the insertion part 7 formed in the frame 6A in the state where the high voltage power source substrate 8 is attached to the frame 6A. Therefore, it is possible to cause the connection electrode 100 to securely contact the output electrode 91 of the mold type transformer 90, and thereby it becomes possible to cause the coil spring 70 to securely contact the output electrode 91 of the mold type transformer 90. As a result, it becomes possible to prevent occurrence of electric connection failure between the connection electrode 100 and the high voltage power source substrate 8.

In this case, even when the coil spring 70 is used as the first conductive member, the coil spring 70 is hard to be buckled, and thereby it becomes possible to cause the coil spring 70 to securely contact the output electrode 91 of the mold type transformer 90

Second Embodiment

Hereafter, a second embodiment is described with reference to FIGS. 11 to 13. Since the second embodiment is different from the first embodiment in regard to only the configuration of the insertion part of the second conductive member, the following explanation focuses on the difference with respect to the first embodiment.

Figure 11:
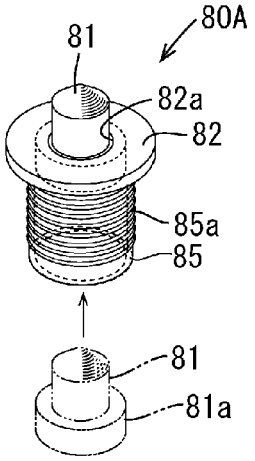
FIG. 11 is a perspective view illustrating a second conductive member according to a second embodiment.

As shown in FIG. 11, a second conductive member 80A according to the second embodiment includes a contacting part 81, a flange part 82 and a fixing part 85 formed in a cylindrical shape. On an outer circumferential surface of the fixing part 85, a male thread part 85*a* is formed. The flange part 82 and the male thread part 85*a* are formed integrally. The contacting part 81 has a wide diameter part 81*a*, and is formed separately from the flange part 82 and the male thread part 85*a*.

The flange part 82 has a through hole 82*a* into which the contacting part 81 is inserted. As shown in FIG. 11, the contacting part 81 is used in a state where the contacting part 81 penetrates the through hole 82*a* of the flange part 82 via the male thread part 85*a*. That is, the contacting part 81 is provided to be movable in the inserting direction of the second conductive member 80A by the input electrode Pin1 of the attached process unit 40K.

That is, by the input electrode Pin1 of the process unit 40K pressing the contacting part 81 of the second conductive member 80A toward the output electrode 91 of the mold type transformer 90, the contacting part 81 is moved in the inserting direction and the coil spring 70 shrinks accordingly. As a result, the connection between the input electrode Pin1 of the process unit 40K and the output electrode 91 of the mold type transformer 90 is securely maintained (se FIG. 13).

Figure 12:
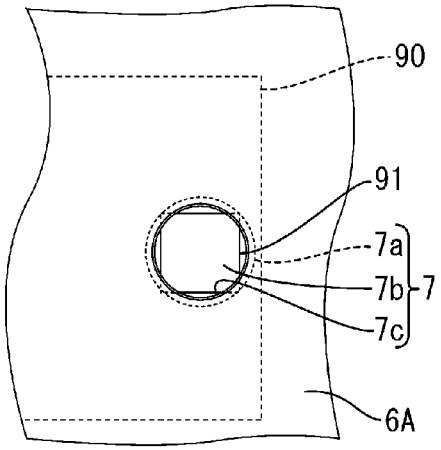
FIG. 12 is a partial plan view illustrating a positional relationship between an insertion part and an output electrode according to the second embodiment.
Figure 13:
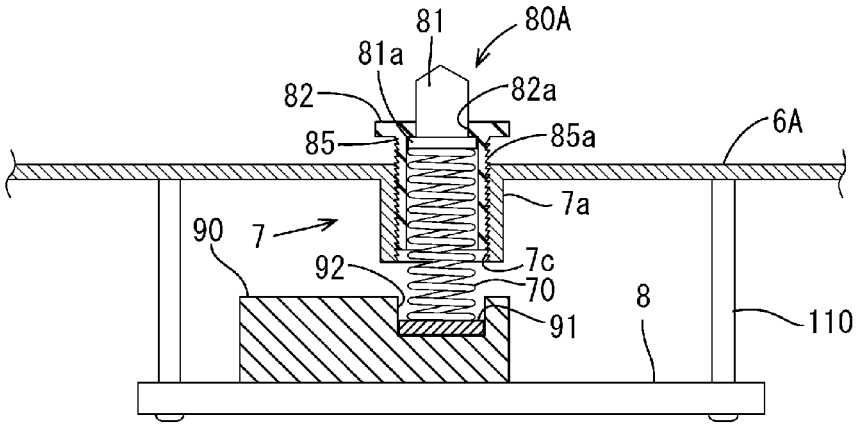
FIG. 13 is a cross sectional view illustrating an attaching manner of a connection electrode to an insertion part according to the second embodiment.

The insertion part 7 of the frame 6A has an opening 7*b* which is circular when viewed as a plan view as shown in FIG. 12, and a cylindrical insertion wall 7*a* as shown in FIGS. 12 and 13. On an inner circumferential surface of the insertion wall 7*a*, a female thread 7*c* is formed. Therefore, in the second embodiment, when the second conductive member 80A is inserted into the insertion part 7, the male thread 85*a* of the fixing part 85 is screwed to the female thread 7*c* of the insertion part 7. That is, in the second embodiment, by screwing the second conductive member 80A to the insertion part 7, the second conductive member 80A is fixed to the insertion part 7.

6. Advantageous Effect of Second Embodiment

Since the second conductive member 80A is screwed to the frame 6A, the second conductive member 80A can be fixed to the frame 6A more securely in comparison with the case where fixing of the second conductive member 80 to the frame is achieved through use of a force of the spring part 83 as described in the first embodiment. Further, replacement work of the connection electrode 100 can be achieved more easily.

Other Embodiments

It is understood that the present invention is not limited to the above described embodiments explained with reference to the accompanying drawings, and other embodiments described below are also included in the scope of the invention.

(1) In the above described embodiment, the output electrode of the mold type transformer included in the high voltage power unit 50 mounted on the high voltage power source substrate 8 is connected to the input electrode of a corresponding attachment unit through use of the connection electrode 100; however, embodiments are not limited to such a configuration. Embodiments may be applied to various types of electric connections between an output electrode provided on a power source substrate and an input electrode provided on an attachment unit.

Figure 14:
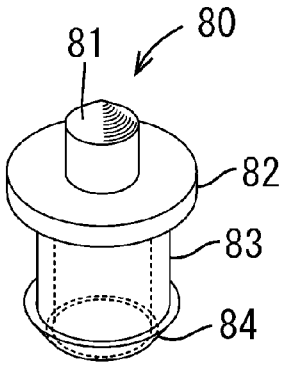
FIG. 14 is a perspective view illustrating another type of second conductive member according to the first embodiment.

(2) The shape of the second conductive member 80 according to the first embodiment is not limited to the one shown in FIG. 6. For example, as shown in FIG. 14, the shape of the second conductive member 80 may be a cylindrical shape as in the case of the second embodiment. In this case, the insertion part 7 of the frame 6A may be formed to have a circular shape when viewed as a plan view as shown in FIG. 12.

Figure 15:
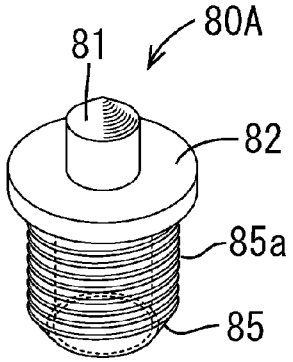
FIG. 15 is a perspective view illustrating another type of second conductive member according to the second embodiment.

The shape of the second conductive member 80A according to the second embodiment is not limited to the one shown in FIG. 11. For example, the contacting part 81 may not be formed as a separate member, but the connecting part 81 may be formed integrally with the flange part 82 as shown in FIG. 15. This configuration can be applied to the case where an input electrode provided in an attachment unit is formed to be extendable.

Figure 16:
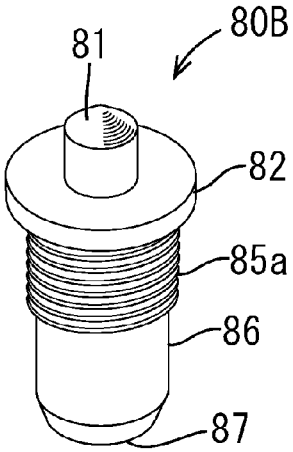
FIG. 16 is a perspective view illustrating another type of second conductive member.

Further, as shown in FIG. 16, the second conductive member 80A shown in FIG. 15 may be configured such that the fixing part 85 is formed as a fixing part 85A which is elongated in the axis direction and that a projected part 87 which contacts the output electrode of the power source substrate is formed on the bottom of the fixing part 85A. The length of the fixing part 85A in the axis direction is set to a length by which the projected part 87 contacts the output electrode provided on the power source substrate when the fixing part 85A is screwed to the insertion part 7. In this case, the connection electrode 100 can be formed only by the second conductive member 80B.

What is claimed is:

1. An image forming apparatus, comprising:

a frame body to which an attachment unit is detachably attachable, the attachment unit being configured to have an input electrode and to be used for image formation on a recording medium;

a power source substrate configured to have an output electrode for outputting a voltage and to be attached to the frame body from an opposite side with respect to a side on which the attachment unit is attached; and a connection electrode configured to electrically connect the output electrode to the input electrode of the attachment unit, wherein the frame body comprises an insertion part into which the connection electrode is inserted from an opposite side with respect to a side on which the power source substrate is attached.

2. The image forming apparatus according to claim 1, wherein the connection electrode comprises:

a first conductive member contacting the output electrode of the power source substrate; and a second conductive member contacting the input electrode of the attachment unit.

3. The image forming apparatus according to claim 2, wherein the first conductive member comprises a pressing member which is capable of expanding and contracting in a direction in which the connection electrode is inserted into the insertion part.

4. The image forming apparatus according to claim 3, wherein the pressing member comprises a coil spring.

5. The image forming apparatus according to claim 2, wherein the second conductive member comprises a fixing part fixed to the insertion part in a state where the second conductive member is inserted into the insertion part.

6. The image forming apparatus according to claim 5, wherein the insertion part of the frame body is made of resin, and wherein the fixing part comprises:

a spring part; and a stopper part formed at a tip portion of the spring part, the stopper part being configured to enlarge the insertion part when being inserted into the insertion part and to be hooked to the insertion part after being inserted into the insertion part.

7. The image forming apparatus according to claim 6, wherein the second conductive member comprises a moving part which is moved in an inserting direction of the connection electrode by the input electrode of the attachment unit attached to the frame body.

8. The image forming apparatus according to claim 5, wherein:

the insertion part comprises a female screw part; and the fixing part of the second conductive member comprises a male screw part which is screwed to the female screw part of the frame body.

9. The image forming apparatus according to claim 1, wherein:

the power source substrate comprises a mold type transformer molded with insulating resin;

the output electrode of the mold type transformer is provided on an opposite side with respect to a side on which the mold type transformer contacts the power source substrate;

the mold type transformer has a recessed part on an opposite surface with respect to a surface facing the power source substrate, the recessed part of the mold type transformer being located at a position facing the input electrode of the attachment unit attached to the frame body; and the output electrode is provided in the recessed part.

10. A manufacturing method for an image forming apparatus, the image forming apparatus comprising: a frame body to which an attachment unit used for image formation on a recording medium is detachably attachable; a power source substrate configured to have an output electrode for outputting a voltage to the attachment unit;

a connection electrode configured to electrically connect the output electrode to the input electrode of the attachment unit; and an insertion part formed in the frame body, the method comprising:

attaching the power source substrate to the frame body; and inserting the connection electrode into the insertion part from an opposite side with respect to a side on which the power source substrate is attached to the frame body after the attaching the power source substrate, and contacting the connection electrode to the output electrode of the power source substrate.

11. The manufacturing method according to claim 10, wherein the connection electrode comprises: a first conductive member contacting the output electrode of the power source substrate; and a second conductive member contacting the input electrode of the attachment unit, wherein the inserting the connection electrode comprises:

inserting the first conductive member into the insertion part, and thereby contacting the first conductive member to the output electrode; and inserting the second conductive member into the insertion part, and thereby fixing the first conductive member by the second conductive member and fixing the second conductive member to the frame body.

* * * * *